US006474890B1

(12) United States Patent
Gueret

(10) Patent No.: US 6,474,890 B1
(45) Date of Patent: Nov. 5, 2002

(54) DEVICE FOR PACKAGING AND APPLYING MAKEUP

(75) Inventor: Jean-Louis Gueret, Paris (FR)

(73) Assignee: L'Oreal, Paris (FR)

( * ) Notice: Subject to any disclaimer, the term of this patent is extended or adjusted under 35 U.S.C. 154(b) by 963 days.

(21) Appl. No.: 08/641,641

(22) Filed: May 1, 1996

(30) Foreign Application Priority Data

May 5, 1995 (FR) ..... 95 05399

(51) Int. Cl.[7] ..... A46B 11/00
(52) U.S. Cl. ..... 401/126; 401/122
(58) Field of Search ..... 401/122, 129, 401/156, 157, 126

(56) References Cited

U.S. PATENT DOCUMENTS 2,506,035 A * 5/1950 Parker ..... 401/156 X
3,756,731 A * 9/1973 Aubry ..... 401/122
4,370,989 A * 2/1983 Taylor ..... 401/126 X

FOREIGN PATENT DOCUMENTS

DE 2558833 7/1976
EP 0677456 10/1994
FR 1070381 7/1954
WO 90/14284 11/1990
WO 95/11839 5/1995

* cited by examiner

*Primary Examiner*—David J. Walczak
(74) *Attorney, Agent, or Firm*—Oliff & Berridge, PLC

(57) ABSTRACT

The invention relates to a device for packaging and applying makeup, the device includes a rigid elongate tubular body open at one end and having an inside space for containing the makeup, and an applicator for being received in the body. The applicator includes a stalk provided at one end with makeup applicator element and secured at its other end to a handle that has a cap for closing the opening of the body in which the applicator element is engaged. A throat is formed in the body for wringing out the applicator element while the applicator is being withdrawn. The device further includes a moving wall defining the inside space, at least in part, and capable of moving in response to a change of pressure in the space caused by the applicator being withdrawn. While the device is in use, the moving wall is subjected on the outside to atmospheric pressure.

36 Claims, 5 Drawing Sheets

DEVICE FOR PACKAGING AND APPLYING MAKEUP

The present invention relates to the field of makeup accessories, and more precisely to a device for packaging and applying makeup such as mascara.

BACKGROUND OF THE INVENTION

Numerous packaging and applicator devices have been proposed comprising a rigid tubular body open at one end, containing the makeup, and an applicator suitable for being received in the body, comprising a stalk provided at one end with an element for applying makeup and secured at its other end to a handle which simultaneously constitutes a cap suitable for screw engagement on the body to close the opening thereof in which the applicator is engaged. A throat is formed in the body to wring out the applicator while the applicator is being withdrawn.

The makeup inside the body is in the form of an elongate block with an axial recess that may pass right through or that may have an end wall, and the applicator element penetrates into the recess. Because of the recess, the quantity of mascara contained in the body is small compared with the inside volume of the body. Furthermore, a non-negligible fraction of the makeup is unused since the mascara tends to remain stuck to the side walls or the end wall of the body and cannot be picked up by the applicator.

There thus exists a need for a packaging and applicator device with smaller makeup losses.

Another drawback encountered during use of known packaging and applicator devices is due to the fact that the applicator element and the stalk behave like a piston while they are moving in the rigid body. Withdrawing the applicator thus reduces the pressure inside the body, and when the applicator element comes out of the abovementioned throat a disagreeable popping noise is made by the sudden return of atmospheric pressure into the inside of the body.

When the makeup is fluid, the fit between the throat and the stalk of the applicator is close so as to wipe the stalk. This avoids leaving makeup on the stalk which might otherwise run towards the cap while the applicator is in use, and thus clog its threads. This close fit contributes to increasing suction during withdrawal of the applicator and to making the popping noise louder. In addition, when the applicator is withdrawn, the mascara wiped off the stalk builds up at the periphery of the throat and forms a mass which is sprayed by the Venturi effect onto the applicator element as it comes out from the throat and air rushes suddenly into the rigid body. Such spraying of mascara at the end of the applicator element is naturally inconvenient for the user and gives rise to makeup being lost.

Publication WO 95/11839 describes a device comprising a rigid tubular body open at one end and having an inside space suitable for containing the makeup, and an applicator suitable for being received in said body, the applicator including a stalk provided at one end with a makeup applicator element and secured at its other end to a handle that simultaneously constitutes a cap suitable for closing the opening of the body in which the applicator element is engaged, a throat also being formed in said body for wringing out the applicator element while the applicator is being withdrawn. That applicator device includes an elastically deformable flexible bag defining said inside space and capable of shrinking gradually as the quantity of makeup contained in the bag decreases.

The throat is constituted by a valve which isolates the inside of the bag in sealed manner after the applicator has been withdrawn.

Such a device runs the risk of damaging the applicator element, either as it passes through the valve, or else by being pressed against the walls of the bag once the bag has contracted after a certain amount of makeup has been removed.

In that device, in order to limit the extent to which the walls of the bag press against one another as the bag empties, attempts are made to enclose the bag in sealed manner inside the rigid body so as to set up suction outside the bag as the volume of the bag decreases.

OBJECTS AND SUMMARY OF THE INVENTION

An object of the present invention is to provide a novel packaging and applicator device that remedies the abovementioned drawbacks.

The device is of the type comprising a device for packaging and applying makeup, the device comprising a rigid elongate tubular body open at one end and having an inside space suitable for containing said makeup, and an applicator suitable for being received in said body, the applicator including a stalk provided at one end with a makeup applicator element and secured at its other end to a handle that simultaneously constitutes a cap suitable for closing the opening of the body in which the applicator element is engaged, a throat being formed in said body for wringing out the applicator element while the applicator is being withdrawn, the device further including a moving wall defining said inside space at least in part and capable of moving in response to a change of pressure in said space caused by the applicator being withdrawn.

In characteristic manner, while the device is in use, said moving wall is subjected on the outside to atmospheric pressure.

In a preferred embodiment of the invention, said inside space communicates with the outside through said throat after the applicator element has been withdrawn.

In a preferred embodiment of the invention, said moving wall is suitable for moving during return of the applicator to avoid pressure increasing in said inside space.

In an embodiment of the invention, said moving wall is constituted by a flexible bag.

Advantageously, a space is provided between the outside surface of the flexible bag and the inside surface of the body to allow the bag to expand during return of the applicator.

In another embodiment of the invention, said moving wall is constituted by a piston slidably mounted in said body.

In another variant of the invention, said moving wall is constituted by a deformable end wall fixed to the end of the rigid body remote from the applicator-insertion opening.

BRIEF DESCRIPTION OF THE DRAWINGS

Other characteristics and advantages of the present invention appear on reading the following detailed description of non-limiting embodiments of the invention, and on examining the accompanying drawings, in which.

MORE DETAILED DESCRIPTION

Figure 1:
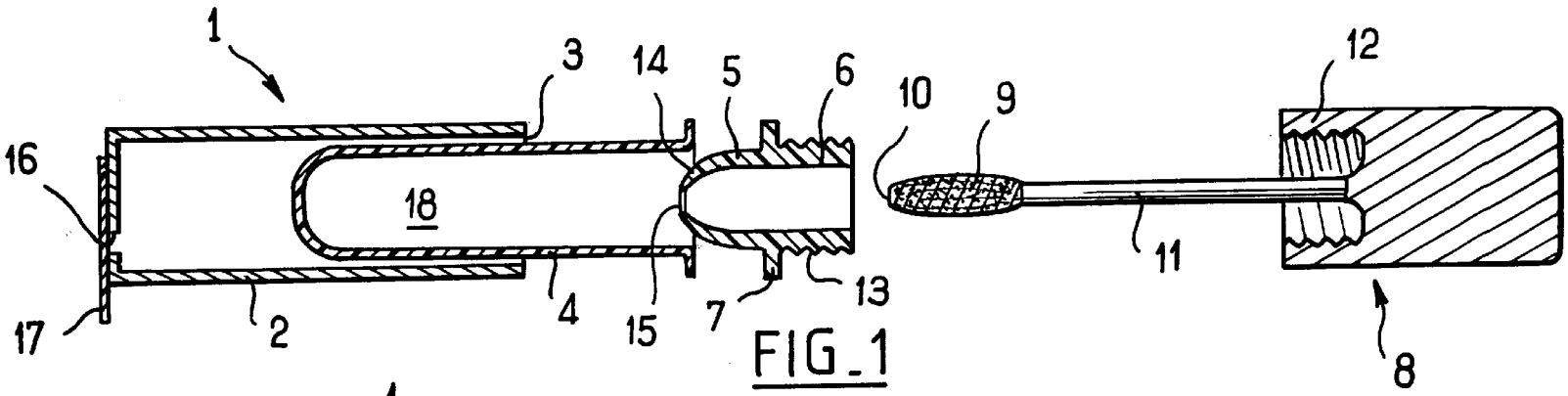
FIG. 1 is a diagrammatic exploded axial section view of a packaging and applicator device comprising a first embodiment of the invention.
Figure 2:
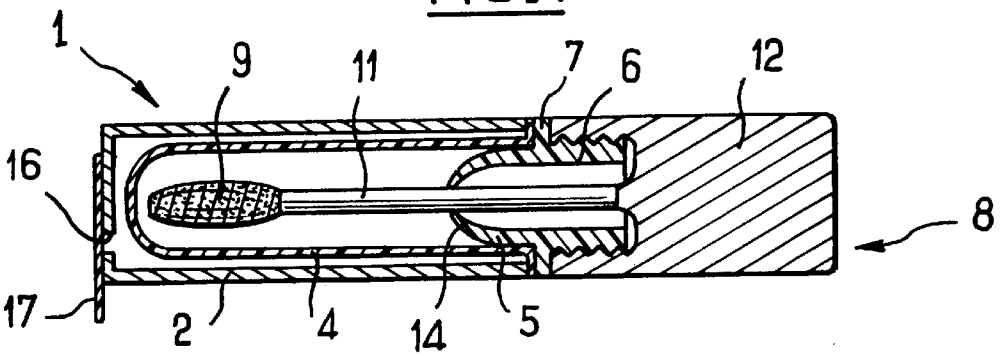
FIG. 2 shows the FIG. 1 device after its component parts have been assembled together.
Figure 3:
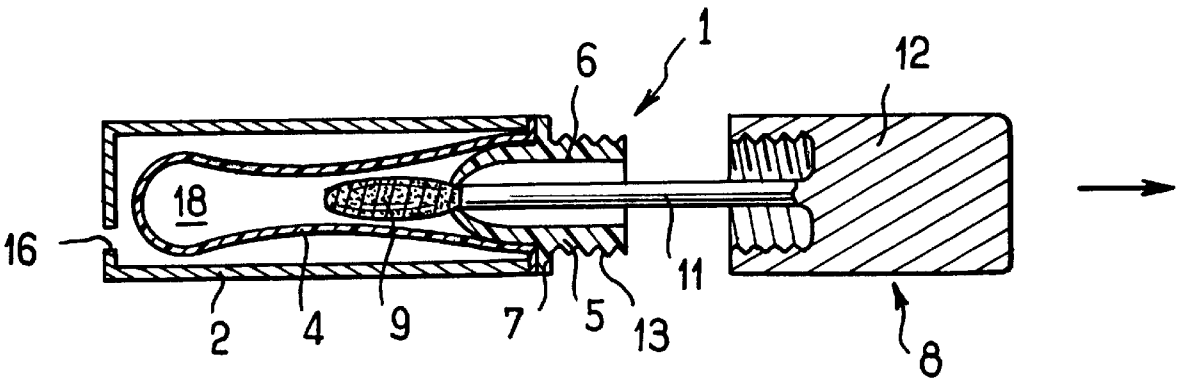
FIG. 3 shows the device of FIGS. 1 and 2 while the applicator is being withdrawn.

The packaging and applicator device 1 constituting a first embodiment of the invention and shown in FIGS. 1 to 3 comprises an elongate tubular body 2 that is open at one end 3 and made of a rigid material. The body 2 receives internally a flexible and elongate tubular bag 4 that is to contain the makeup. The bag 4 is closed at one axial end, and at its other axial end which is open, it is fixed to an endpiece 5 having an inside channel 6 passing therethrough on the longitudinal axis of the body 2. The endpiece 5 is provided on its outside, on its periphery, with a collar 7 projecting radially outwardly and suitable for engaging the end face 3 of the body 2.

The packaging and applicator device 1 includes an applicator 8 comprising an applicator element 9 for inserting via its end 10 into the body 2, and extended at its other end by a stalk 11 secured to a threaded cap 12 that serves both as a handle and as a stopper for closing the body 2. The cap 12 is screwed onto a thread 13 formed on the endpiece 5, and when screwed home it comes into axial abutment against the collar 7. The applicator element is then received in the bag 4, and the stalk 11 passes along the inside channel 6.

The section of the channel tapers progressively going towards the body 2. The section is at its minimum at the free end of an annular lip 14 defining a throat 15 for wringing out the applicator element 9. If the makeup is fluid, the diameter of the throat 15 is also adapted to wipe the stalk 11.

An orifice 16 whose function is specified below is provided through the end wall of the body 2, remote from the end 3. This orifice 16 is advantageously closed during storage, prior to use of the device 1, by a removable capsule 17, e.g. a plastics tab.

The flexible bag 4 constitutes a moving wall that defines inside the body a space 18 for containing the makeup (not shown in the drawing for reasons of clarity) and of a volume that can vary in response to variations in pressure caused by withdrawing the applicator 8.

More precisely, departure of the applicator 8 tends to set up suction in the space 18, with the applicator element 9 and the stalk 11 then acting as a piston. The bag 4 is capable of deforming, as shown in FIG. 3, with its side walls collapsing to compensate for the suction caused by the displacement of the stalk 11 and the applicator element 9, such that the element passes through the throat 15 without making a popping noise and without makeup being sprayed or collecting at the end of the applicator element 9, unlike prior art devices.

Also, the deformation of the bag 4 makes available to the applicator element 9 any makeup that has remained stuck to the side walls. The quantity of makeup that can be extracted by the applicator element 9 is thus increased relative to prior art devices.

It will be observed that after the applicator element 9 has been fully withdrawn, the bag 4 is subjected both inside and outside to atmospheric pressure. The space 18 is in communication with the outside through the endpiece 5 while the orifice 16 enables atmospheric pressure to be maintained on the outside face of the bag 4.

Figure 4:
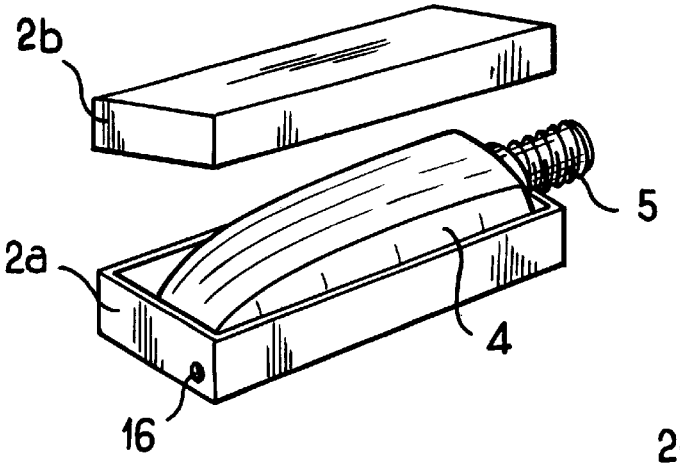
FIG. 4 is a diagrammatic perspective view of a first embodiment of the rigid body.
Figure 5:
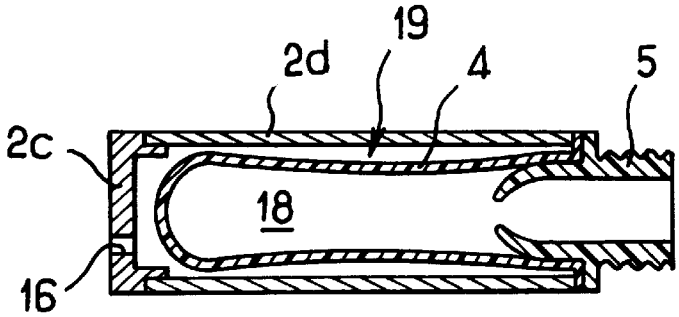
FIG. 5 is a diagrammatic axial section of a second embodiment of the rigid body.
Figure 6:
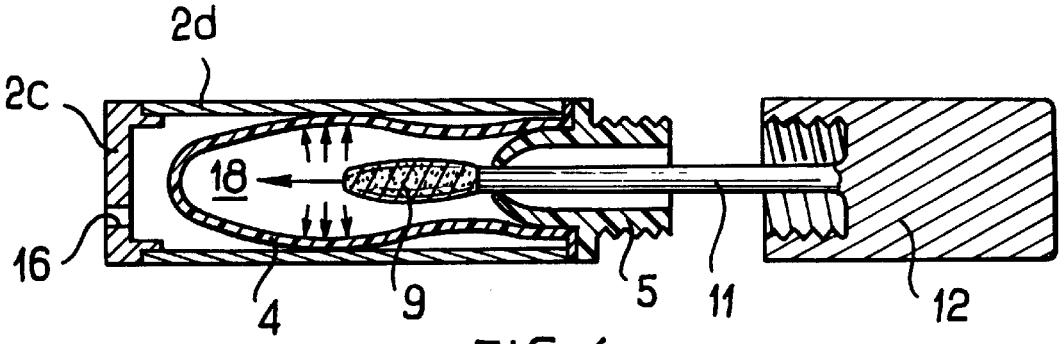
FIG. 6 shows the FIG. 5 device while the applicator is being returned.

The rigid body 2 can be made by assembling together two half-shells 2*a* and 2*b* as shown in FIG. 4, or by engaging an end wall 2*c* in a rigid tube 2*d* that is open at both axial ends, as shown in FIG. 5. In the FIG. 4 example, the body is assembled together after the flexible bag 4 and the endpiece 5 have been installed in one of the half-shells. Advantageously, an annular empty space 19 is left between the outside surface of the bag 4 and the inside surface of the body 2 so as to allow the bag 4 to expand inside the body 2 while the applicator is being returned, as shown in FIG. 6. This deformation of the bag 4 serves to avoid excess pressure building up in the inside space 18 which could have the effect of causing makeup on the stalk 11 to be sprayed out after the applicator element has gone through the throat which serves to wring out the applicator element.

The flexible bag 4 may be made of a plastics material selected so that it returns to its initial shape after the applicator element 9 has been removed. The flexible bag 4 may be made of metallized or laminated materials such as polyester-aluminum-polyethylene or polyester-ceramic-polyethylene, or polyester-aluminum powder-polyurethane-polyethylene.

The endpiece 5 may be integrally molded with the bag 4. FIGS. 7 to 10 show four embodiments of the bag.

Figure 7:
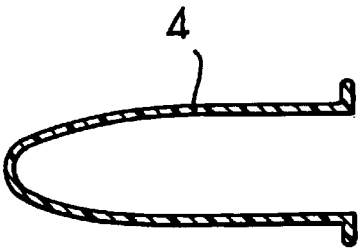
FIG. 7 is an axial section through a first embodiment of the flexible bag.

In the embodiment of FIG. 7, the bag 4 is made by an injection molding technique, a dipping technique, or an electrostatic deposition technique. At its free edge, the bag 4 has an annular rim projecting radially outwards and designed to be interposed axially between the end face 3 of the body 2 and the endpiece 5 when the device 1 is assembled together.

Figure 8:
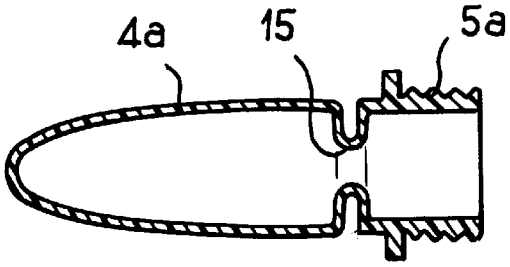
FIG. 8 is an axial section through a second embodiment of the flexible bag.

In the embodiment of FIG. 8, the bag given reference 4*a* and the endpiece given reference 5*a* comprise a single part. The throat 15 is constituted by an inwards fold of the wall connecting the bag 4*a* to the endpiece 5*a*. The endpiece 5*a* is made by an injection molding technique while the bag 4*a* is made by a blow molding technique. The throat 15 is formed by blow molding with the bag 4*a*.

Figure 9:
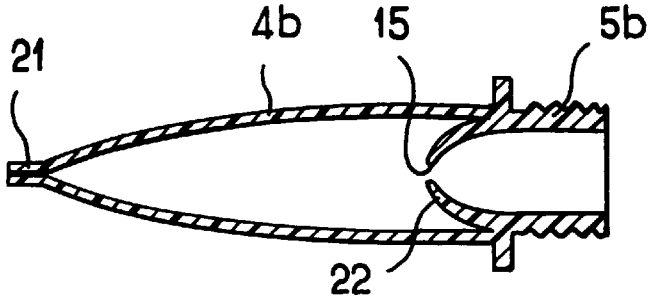
FIG. 9 is an axial section through a third embodiment of the flexible bag.

In the embodiment of FIG. 9, the bag referenced 4*b* and the endpiece referenced 5*b* likewise constitute a single part.

The bag 4*b* is made by an extrusion technique while the endpiece 5*b* is made by an injection molding technique. The end 21 of the bag 4*b* is closed by heat-sealing. The throat 15 is formed by the free end of an annular lip 22.

Figure 10:
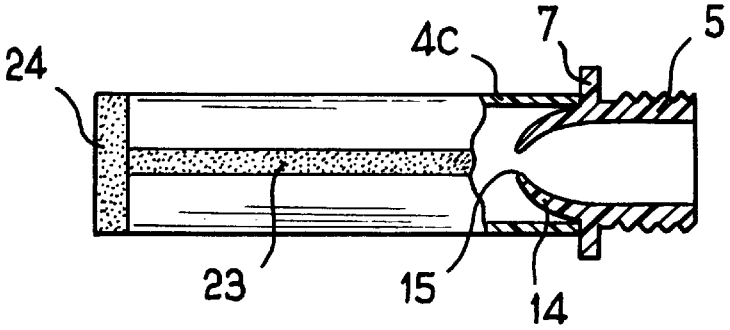
FIG. 10 is a side view, in fragmentary axial section, of a fourth embodiment of the flexible bag.

In the embodiment shown in FIG. 10, the bag, referenced 4*c,* is made by rolling up a sheet of plastics material and heat-sealing its longitudinal edges together at 23. The end 24 is heat sealed. The endpiece is identical to the endpiece referenced 5 and described above with reference with FIGS. 1 to 3. The end face of the bag 4*c* rests against the collar 7 and it is heat sealed to the base of the annular lip 14 of the endpiece 5.

Figure 11:
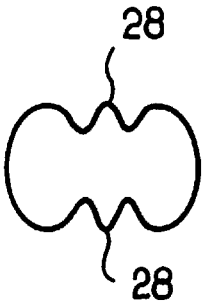
FIGS. 11 and 12 are cross-sections through two embodiments of flexible bags in accordance with the invention.
Figure 12:
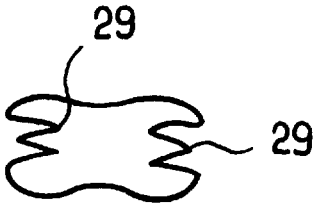

The cross-section of the flexible bag may be circular, elliptical, or other. It is possible to form folds in the bag so as to increase and/or direct deformation thereof. By way of example, FIGS. 11 and 12 show cross-sections of two bags each having a generally rectangular section, with one of the bags having longitudinal folds 28 situated in both of the large sides of its section, while the other has longitudinal folds 29 situated in both of the small sides of its section.

Figure 13:
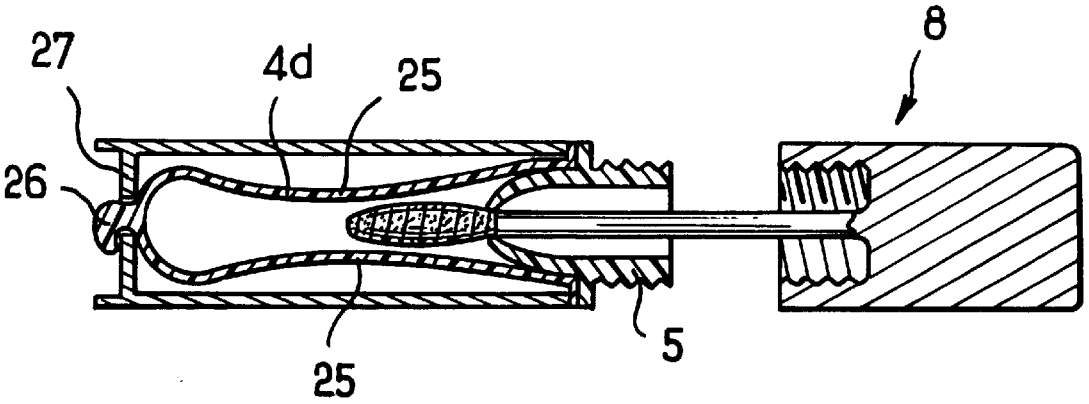
FIG. 13 is a diagrammatic axial section view of a first variant embodiment of a packaging and applicator device of the invention.

In a variant embodiment of the packaging and applicator device of the invention, as shown in FIG. 13, the bag, referenced 4*d,* has its end fixed to the rigid body 2, thereby promoting inward deformation of the side walls 25 of the bag 4*d* while the applicator 8 is being withdrawn. In the example shown, the end of the bag 4*d* is secured by an appendix 26 extending from the end of the bag 4*d* remote from the endpiece 5 engaging with an annular rib 27 projecting radially inwards from the inside surface of the body 2.

Figure 14:
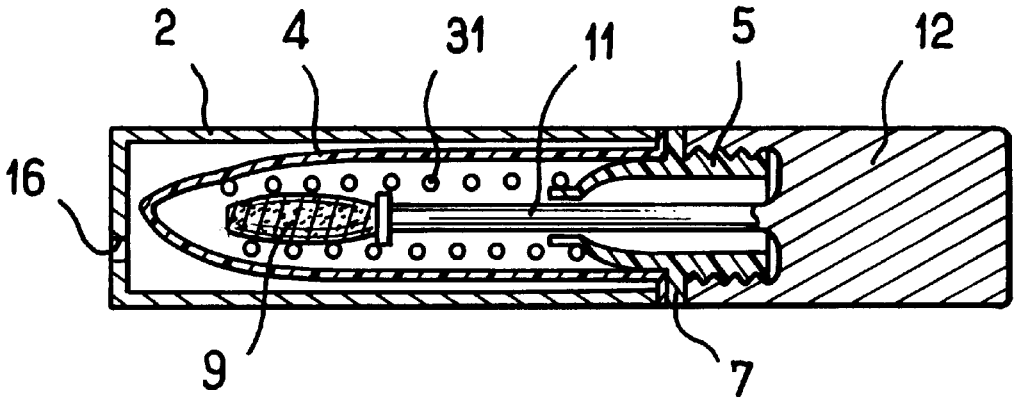
FIG. 14 is a diagrammatic axial section view of a second variant embodiment of a packaging and applicator device of the invention.

Advantageously, as shown in FIG. 14, reinforcement 31 is placed inside the flexible bag in order to restrict the amplitude of the inward deformation of the side walls of the bag so as to avoid the applicator element 9 being pressed between the side walls when the applicator 8 is withdrawn. In the example described, the reinforcement 21 is helically wound with spaced-apart turns, being fixed at an axial end to the endpiece 5.

Figure 15:
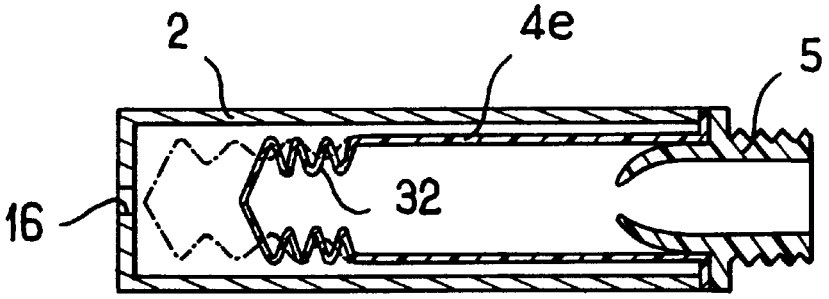
FIG. 15 is a diagrammatic axial section view of a third variant embodiment of a packaging and applicator device of the invention.

In the embodiment of FIG. 15, the bag, referenced 4*e,* is capable of deforming axially along the longitudinal axis of the body 2 because a bellows 32 is formed close to its end. When a pressure rise tends to be generated inside the bag 4*e* by return of the applicator, the bellows 32 expands (to take up the shape drawn in chain-dotted lines) and accommodates the extra pressure by increasing the inside volume of the bag. In contrast, when the applicator is withdrawn, the bellows 32 folds up so as to reduce the inside volume of the bag and accommodate the suction caused by withdrawing the applicator.

All of the embodiments described above include the orifice 16 formed through the body 2 to allow the space between the inside surface of the body and the outside surface of the bag to communicate with the outside, in order to maintain atmospheric pressure continuously. As explained above, this orifice 16 through the end wall of the body 2 is advantageously closed during storage by the capsule 17. The body 2 then co-operates with the bag to form two sealing barriers, thereby promoting long-duration conservation of the makeup contained in the bag.

Figure 16:
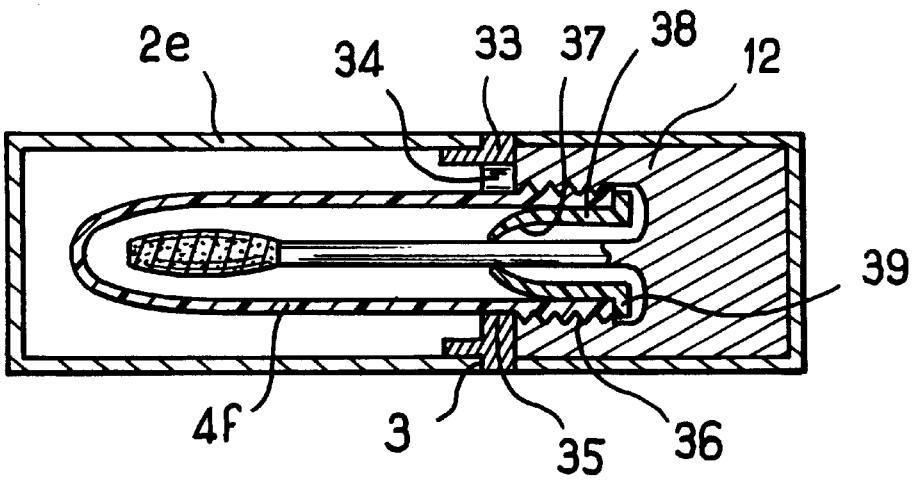
FIG. 16 is a diagrammatic axial section view of a fourth variant embodiment of a packaging and applicator device of the invention.

In a variant, the vent can be provided adjacent to the insertion opening for the applicator, as shown in FIG. 16. In this embodiment, a flexible sealing ring 33 is applied to the end face 3 of the rigid body given. reference 2*e,* and a vent 34 is provided in the annular gap situated between the periphery of the sealing ring 33 and the outside surface of the bag referenced 4*f.* The vent 34 causes the space between the outside surface of the bag and the inside surface of the rigid body 2*e* to communicate with the outside. During storage, the cap 12 presses against the sealing ring 33 and isolates the vent 34 from the outside. The sealing ring 33 is in mutual engagement with the rigid body 2*e* as shown in FIG. 16. It has a central hole 35 through which the bag 4*f* passes. The bag is fixed to the central hole 35 of the sealing ring 33 by heat-sealing or by adhesive. A thread 36 is formed on the bag 4*f* outside the rigid body 2*e* for screw engagement with the cap 12. The throat 15 is formed at the free end of an annular lip 37 secured to a sleeve 38 fitted in the opening of the bag 4*f.* At one axial end, the sleeve has a collar 39 that bears against the end edge of the bag 4*f.*

Figure 17:
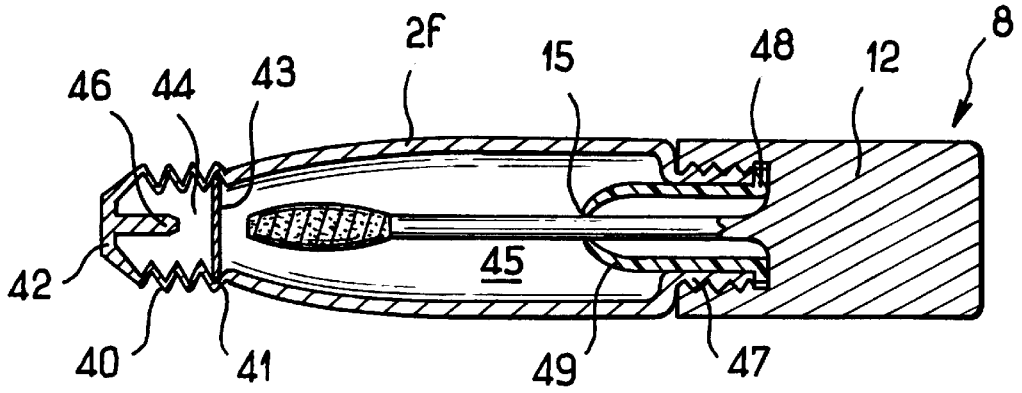
FIG. 17 is a diagrammatic axial section view of a fifth variant embodiment of a packaging and applicator device of the invention.

In another variant embodiment of a packaging and applicator device of the invention, as shown in FIG. 17, the flexible bag is omitted and the elongate rigid body referenced 2*f* is provided at its axial end remote from the applicator-insertion opening with a deformable end wall that includes a bellows 40. The bellows is fixed at one axial end 41 to the body 2*f* and it is closed at its opposite axial end by a disk 42. During storage, the space 44 inside the bellows 40 is advantageously isolated by a partition 43 from the inside of the rigid body that contains the makeup. In the example described, the partition 43 is constituted by an aluminum membrane. The disk 42 is provided with a spike 46 contained inside the bellows 40 during storage and pointing towards the partition 43. The spike is capable of puncturing the partition on first use of the device. For this purpose, the disk 42 is moved by the user towards the rigid body 2*f* until the partition 43 has been punctured by the spike 46. The body 2*f* has a neck 47 with an outside thread for receiving the cap 12. A sleeve 52 is received in the neck 47. It is provided at one axial end with a collar 48 that bears against the end face of the neck 47 and at its other axial end with an inwardly curving annular lip 49 whose free edge defines the throat 15. After the partition 43 has been punctured, withdrawal of the applicator 8 causes the bellows 44 to fold up, thereby enabling atmospheric pressure to be maintained inside the space 45. Re-insertion of the applicator causes the bellows 44 to expand longitudinally, thereby reducing or eliminating the extra pressure in the space 45.

Figure 18:
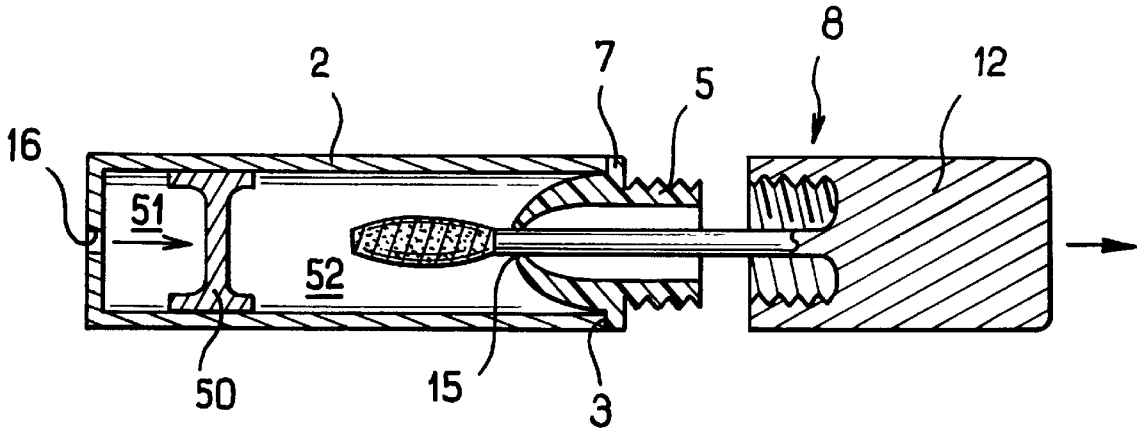
FIG. 18 is a diagrammatic axial section view of a sixth variant embodiment of a packaging and applicator device of the invention.

Naturally, the invention is not limited to the embodiments described above. In particular, as illustrated by the variant embodiment shown in FIG. 18, it is possible to replace a flexible bag or a deformable end wall with a piston 50 that is slidably mounted inside the rigid body 2. The piston 50 then defines two spaces of variable volume inside the body 2, one of the spaces referenced 51 communicates with the outside via the orifice 16 while the other space referenced 52 contains the makeup and receives the applicator 8. A decrease or increase of the pressure inside the space 52 caused by withdrawal or insertion of the applicator causes the piston 50 to move along the longitudinal axis of the body 2, respectively to the right and to the left in FIG. 2, thereby almost instantaneously reestablishing atmospheric pressure in the space 52 by changing its volume.

Finally, the invention serves to avoid a popping noise being made when the applicator is withdrawn, remedies the problem of makeup collecting at the end of the applicator element, and increases the quantity of makeup that can be recovered by the applicator in comparison with known devices.

What is claimed is:

1. A device for packaging and applying makeup, the device comprising a rigid elongate tubular body open at one end and having an inside space for containing said makeup, and an applicator for being received in said body, the applicator including a stalk provided at one end with a makeup applicator element and secured at its other end to a handle that simultaneously constitutes a cap for closing the opening of the body in which the applicator element is engaged, a throat being formed in said body for wringing out the applicator element while the applicator is being withdrawn, the device further including a moving wall defining said inside space at least in part, that is subject on the outside to atmospheric pressure when the device is in use and is capable of moving in response to a change of pressure in said inside space caused by the applicator element being withdrawn, wherein the withdrawal of the applicator element causes the inside space to have a lower pressure than atmospheric pressure and wherein the moving wall moves to equalize the inside space pressure with the atmospheric pressure.

2. A device according to claim 1, wherein said inside space communicates with the outside through said throat after the applicator element has been withdrawn.

3. A device according to claim 1, wherein said moving wall is suitable for moving during return of the applicator to avoid pressure increasing in said inside space.

4. A device according to claim 1, wherein said moving wall is constituted by a flexible bag.

5. A device according to claim 4, wherein said flexible bag includes an end wall fixed to said body.

6. A device according to claim 4, wherein said flexible bag is provided on the inside with reinforcement suitable for limiting inward deformation of the side walls of the bag.

7. A device according to claim 4, further including a threaded endpiece for screw engagement of the cap on the body, the device being wherein the threaded endpiece is internally molded with the flexible bag.

8. A device according to claim 4, wherein said throat is integrally formed with the flexible bag by blow molding.

9. A device according to claim 4, wherein the flexible bag includes longitudinal folds designed to facilitate and to direct deformation thereof.

10. A device according to claim 4, wherein the flexible bag includes a bellows suitable for deforming along the longitudinal axis of said body.

11. A device according to claim 4, wherein a space is provided between the outside surface of the flexible bag and the inside surface of the body to allow the bag to expand during return of the applicator.

12. A device according to claim 4, wherein said rigid body has a vent passing therethrough enabling atmospheric pressure to be maintained outside said flexible bag.

13. A device according to claim 1, wherein said moving wall is constituted by a piston slidably mounted in said body.

14. A device according to claim 1, wherein a vent is provided in the body to maintain atmospheric pressure on the face of said moving wall facing away from said inside space.

15. A device according to claim 1, wherein said moving wall is constituted by a deformable end wall fixed to the end of the rigid body remote from the applicator-insertion opening.

16. A device according to claim 15, wherein said deformable end wall includes a bellows suitable for deforming along the longitudinal axis of said body.

17. A device according to claim 15, including a puncturable partition suitable for isolating said deformable wall from the inside of the body during storage, and wherein said deformable wall is provided with means enabling said partition to be punctured on first use of the device.

18. A device for packaging and applying make-up, the device comprising:

a rigid elongate tubular body open at one end and having an inside space for containing said makeup;

an applicator for being received in said body, the applicator including a stalk provided at one end with a makeup applicator element and secured at its other end to a handle that simultaneously constitutes a cap for closing the opening of the body in which the applicator element is engaged, an open throat being formed in said body for wringing out the applicator element and the stalk while the applicator is being withdrawn; and a moving wall defining said inside space at least in part and capable of moving in response to a change of pressure in said inside space caused by the applicator being withdrawn, wherein, while the device is in use, said moving wall is subjected on the outside to atmospheric pressure, wherein said inside space communicates with the outside through said open throat after the applicator element has been withdrawn, wherein the withdrawal of the applicator element causes the inside space to have a lower pressure than atmospheric pressure and wherein the moving wall moves to equalize the inside space pressure with the atmospheric pressure.

19. A device for applying makeup comprising:

a rigid body open at one end and having an inside space for containing said makeup;

an applicator for being received in said body, the applicator including a stalk provided at one end with an applicator element;

a wiper member configured to wipe the applicator element while the applicator is being withdrawn; and a moving wall defining at least partially said inside space, said moving wall being subject on an outside face to atmospheric pressure when the device is in use and being configured to move in response to a change of pressure in said inside space caused by the applicator being withdrawn, wherein the withdrawal of the applicator causes the inside space to have a pressure lower than the atmospheric pressure and wherein the moving wall moves to equalize the inside space pressure with the atmospheric pressure.

20. A device according to claim 19, wherein said inside space communicates with the outside through said wiper after the applicator has been withdrawn.

21. A device according to claim 19, wherein said moving wall is capable of moving during return of the applicator in said body to avoid pressure increasing in said inside space.

22. A device according to claim 19, wherein said moving wall comprises a flexible bag.

23. A device according to claim 22, wherein said flexible bag includes an end wall fixed to said body.

24. A device according to claim 22, wherein said flexible bag is provided on the inside with reinforcement for limiting inward deformation of the bag.

25. A device according to claim 22, comprising a cap for closing the opening of the body and a threaded endpiece for screw engagement of the cap on the body, said threaded endpiece being molded with the flexible bag.

26. A device according to claim 22, wherein said wiper is molded with the flexible bag.

27. A device according to claim 22, wherein the flexible bag includes longitudinal folds configured to facilitate and to direct deformation thereof.

28. A device according to claim 22, wherein the flexible bag includes a bellows configured for deforming along a longitudinal axis of said body.

29. A device according to claim 22, wherein a space is provided between an outside surface of the flexible bag and an inside surface of the body to allow the bag to expand during return of the applicator.

30. A device according to claim 22, wherein said rigid body has a vent passing therethrough enabling atmospheric pressure to be maintained outside said flexible bag.

31. A device according to claim 19, wherein said moving wall comprises a piston slidably mounted in said body.

32. A device according to claim 19, wherein a vent is provided in the body to maintain atmospheric pressure on a face of said moving wall facing away from said inside space.

33. A device according to claim 19, wherein said moving wall comprises a deformable end wall fixed to an opening of the body.

34. A device according to claim 33, wherein said deformable end wall includes a bellows for deforming along the longitudinal axis of said body.

35. A device according to claim 33, including a puncturable partition configured for isolating said deformable wall from inside of the body during storage, said deformable wall being provided with a puncturing element configured to puncture said partition on a first use of the device.

36. A device according to claim 19, wherein the wiper member is configured to wipe the stalk when the applicator is being withdrawn.

* * * * *